United States Patent [19]

Görike

[11] 4,160,135

[45] Jul. 3, 1979

[54] CLOSED EARPHONE CONSTRUCTION

[75] Inventor: Rudolf Görike, Vienna, Austria

[73] Assignee: AKG Akustische u.Kino-Geräte Gesellschaft m.b.H., Austria

[21] Appl. No.: 895,047

[22] Filed: Apr. 10, 1978

[30] Foreign Application Priority Data

Apr. 15, 1977 [AT] Austria ..... 2652/77

[51] Int. Cl.[2] ..... H04R 1/28

[52] U.S. Cl. ..... 179/182 R; 179/181 R

[58] Field of Search ..... 179/156 R, 182

[56] References Cited

U.S. PATENT DOCUMENTS

| | | | |
|---|---|---|---|
| 4,005,278 | 1/1977 | Gorike | 179/181 R |
| 4,071,717 | 1/1978 | Fidi et al. | 179/182 R |

*Primary Examiner*—William C. Cooper

*Attorney, Agent, or Firm*—McGlew and Tuttle

[57] ABSTRACT

An earphone comprises a housing including a partition plate with an opening containing a diaphragm. An annular cushion is secured to the periphery of the partition and engages around the wearer's ear to form a coupling space between the diaphragm and the ear. A back covering is connected to the partition defining a soundproof cavity between the partition and the back covering. A partial wall is spaced from the partition on a side opposite the diaphragm to define a first high restoring force cavity. A duct is connected from the restoring force cavity to the outside, and it encloses an air mass which acts as an acoustic mass.

5 Claims, 11 Drawing Figures

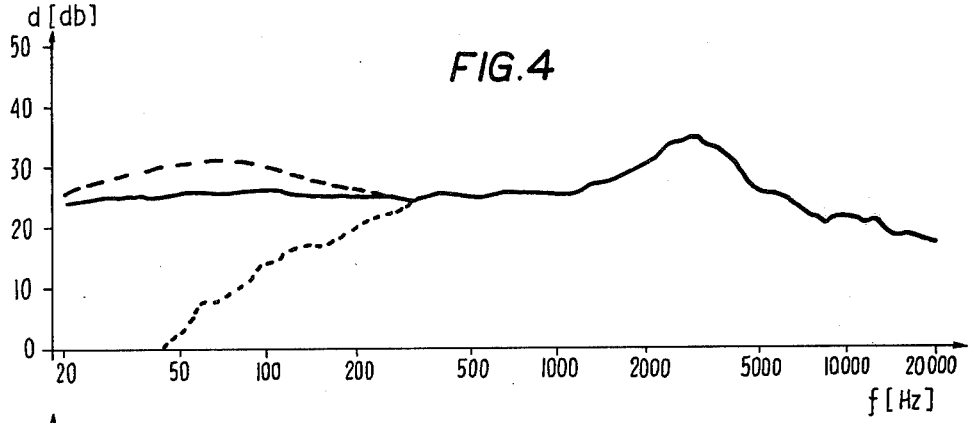
FIG.4
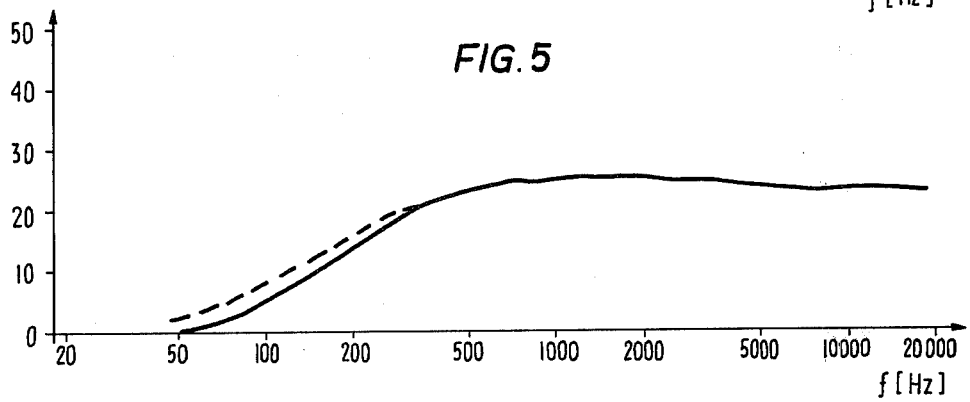
FIG.5
FIG.6
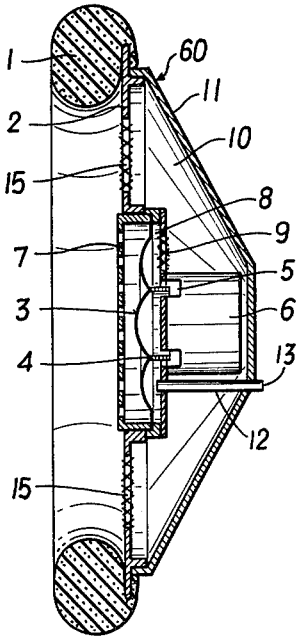
FIG.7
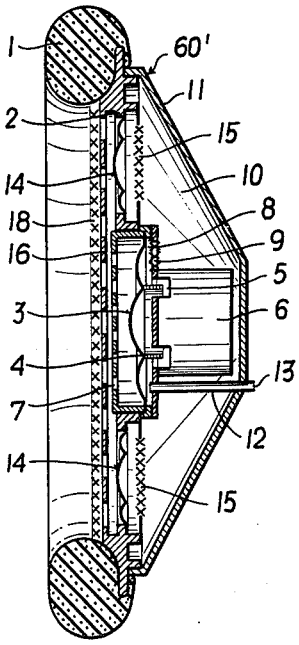
FIG.8
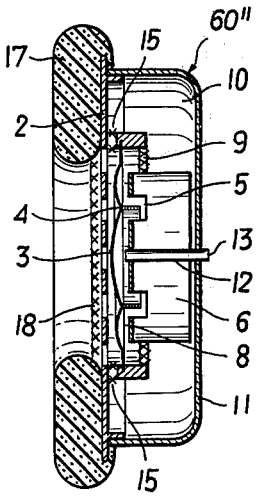

CLOSED EARPHONE CONSTRUCTION

FIELD AND BACKGROUND OF THE INVENTION

This invention relates to earphones in general and, in particular, to a new and useful closed earphone construction, wherein the sound-emitting diaphragm bears tightly on the ear of the wearer with its front side by means of a circum-aural or supra-aural coupling space, and the backside of the diaphragm is coupled with at least one soundproof cavity.

A soundproof cavity, in accordance with the invention, supplies a relatively high restoring force to the diaphragm, particularly when the earphone is flat, for reasons of form design. Ear cushions and the soundproof cavity have the effect that noises coming from the outside cannot penetrate to the ear, and they also prevent sound produced by the earphone from escaping to the outside. Measurements of the sound absorption have shown, however, that ear cushions have only a slight sound absorption for low frequencies, while the absorption values in the remaining frequency range are about 20 db.

Both the permeability of the ear cushions for sound waves of low frequency and the restoring force of the volume of air in the soundproof cavity cause a drop of the frequency curve below 200 Hertz.

SUMMARY OF THE INVENTION

The present invention provides an earphone which is equipped with acoustic means that prevent a loss of sound at low frequencies which occurs in other earphones. According to the invention, this is done by providing a first cavity of high restoring force directly on the backside of the diaphragm. The cavity comprises a small or flat air chamber from which at least one duct extends. The duct encloses an air mass, acting as an acoustic mass and leads to the outside. At least one second cavity is provided in the earphone housing, which is sealed in soundproof fashion from the outside, and which is in communication with the first cavity through an acoustical frictional resistance. The air mass or plug in the duct provides the action of a low pass filter.

Principally, these measures affect a reduction of the natural resonance of the diaphragm by means of the duct leading out of the flat air chamber behind the diaphragm. This is so because the air volume in the form of an air mass enclosed by the duct represents a mass additionally loading the diaphragm. These measures also permit the elimination of the cavity stiffness in the lower frequency range. Both measures together have the effect that the drop in the frequency range below 200 Hertz, appearing normally when an earphone of the above-described type is used, is at least compensated, so that the earphone, according to the invention, also permits an approximately linear frequency course or even a bass-boosting effect in this range.

A further linearization of the frequency course with the earphone attached can be achieved by installing acoustic frictional resistances and/or passive diaphragms in the partition between the cavity which is sealed soundproofly from the outside and the coupling space on the ear. The function of these passive diaphragms is known and therefore is not described herein.

The sound cavity, which is sealed soundproofly from the outside, can preferably be formed, according to the invention, by the earphone housing itself, so that the dimensions of the earphone can be kept small. Finally, it is also advantageous if the duct is continually or gradually variable in its dimensions by mechanical means according to another feature of the invention, in order to adjust different frequency courses in the low frequency range.

A particular advantage in the earphone according to the invention is that the course of the sound pressure on the ear drum, as a function of the frequency, comes very close to that of natural hearing with the naked ear, and that directional and distance-listening is markedly improved with the earphone according to the invention. This is obviously due to the fact that the sufficient sound absorption at frequencies below 200 Hz by the ear cushions, which cannot practically be realized, is not now needed in the earphone according to the invention. The frequency curve is at least linearized in this low frequency range purely by acoustic measures as pointed out above. This is decisively important to provide a natural sound, unaffected by earphone characteristics.

Accordingly, it is an object of the invention to provide an improved earphone which comprises a housing having a partition plate with an opening therethrough and with an electroacoustic converter having a sound-transmitting diaphragm disposed in the opening, the partition being covered on one side by an annular ear cushion forming a coupling space between the diaphragm and the ear and the partition being covered its opposite side by a back covering which is spaced away from the partition to define a soundproof space or cavity behind the diaphragm. A second partial wall is spaced from the first-mentioned partition within the soundproof cavity which defines a first high restoring force cavity with the first partition. A duct is connected from the restoring force cavity to the outside and the duct encloses an air mass or plug which acts on air in the high restoring force cavity and further including an acoustic frictional resistance defining a communication between the restoring force cavity and the soundproof cavity.

A further object of the invention is to provide an earphone which is simple in design, rugged in construction and economical to manufacture.

For an understanding of the principles of the invention, reference is made to the following description of typical embodiments thereof as illustrated in the accompanying drawings.

BRIEF DESCRIPTION OF THE DRAWINGS

In the drawings:

FIG. 4 is a frequency curve of the earphone according to the invention, compared to a known earphone;

FIG. 5 is a curve showing the course of sound absorption in the known earphone and in the earphone constructed in accordance with the invention; and FIGS. 6, 7 and 8 are views similar to FIG. 1*a* of other embodiments of the invention.

DESCRIPTION OF THE PREFERRED EMBODIMENTS

Figure 1A:
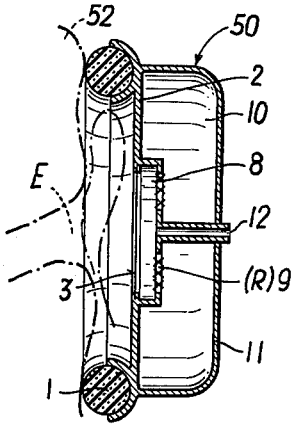
FIG. 1*a* is an elementary construction of an earphone, constructed in accordance with the invention.
Figure 1B:
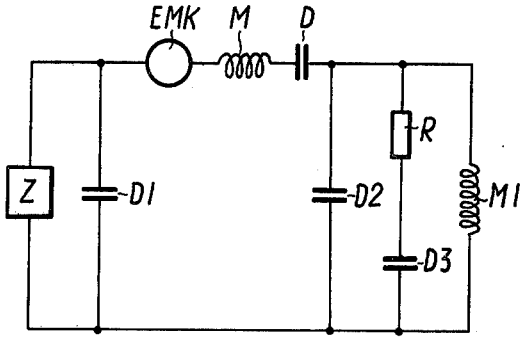
FIG. 1*b* is a circuit diagram of the elements of the earphone shown in FIG. 1*a;*

Referring to the drawings in particular, the invention embodied therein, in FIGS. 1*a* and 1*b*, shown an elementary construction of an earphone 50 constructed in accordance with the invention in FIG. 1*a*, and a corresponding circuit diagram of the elements is shown in FIG. 1*b*.

An annular ear cushion 1 of an earphone 50 bears on a wearer's head 52 when the earphone is in use. The earphone 50 has a converter diaphragm 3, which has a mass M and stiffness D which is rather close to the audio inlet E of the wearer's ear. However, the diaphragm can also be arranged at any other point of partition 2. A small air chamber 8 with high restoring force and having a duct 12 leading to the outside is arranged behind converter diaphragm 3. Partition 2, into which the converter diaphragm 3 is inserted, together with boundary or outside wall 11 encloses a cavity 10. Partition 2 also forms a part of the coupling space between the earphone and the wearer, which encloses an air volume of stiffness or capacity D1. The electric equivalent circuit diagram shown in FIG. 1*b* shows the function of the arrangement in analogous electrical compounds.

Parallel to the ear impedance designated Z, a capacitor is arranged which symbolizes the stiffness D1 of the air volume in the coupling space next to the wearer's head. The drive of the converter diaphragm 3 is represented in the equivalent circuit diagram as a generator EMK, whose internal resistance results as a series-connection of an inductance and a capacitance, corresponding to the diaphragm mass M and the stiffness D of the disphragm. This series-connection is followed by a parallel connection, which contains the following branches: a capacitor D2, which represents the stiffness of the small or low air chamber 8 behind the diaphragm 3; a series-connection consisting of resistor R and capacitor D3, where R represents the frictional resistance in the connecting path between the small or low-air chamber 8 behind diaphragm 3 and cavity 10 which is sealed soundproof from the outside, while the capacitor D3 respresents the stiffness of the air volume enclosed in this cavity 10. Finally, inductance M1 representing the mass of the air plug or mass in duct 12 is shown in parallel-connection with R and D3.

The functioning of the elements according to the invention can readily be understood from the electric equivalent circuit diaphragm. On the one hand, inductance M1, added according to the invention, results in an increase of the inductance M in the series-resonant circuit with the stiffness D of the diaphragm, and of generator EMK. On the other hand, two series resonant circuits are formed in which the capacitors D2 with inductance M, and stiffness D and capacitors D3 with inductance M and stiffness D, which are damped in their action by frictional resistance R, play a role. The dimensioning of the elements of the series resonant circuits M, D, M1 is so selected that a resonance rise appears in the range below 200 Hz to compensate the aforementioned losses in the range. The effect in the frequency course of the earphone below 200 Hz is so strong that the drop caused by a lack of sound absorption in the ear cushions is compensated in this range with the earphones on the wearer, or the frequency curve is raised, as required.

Figure 2A:
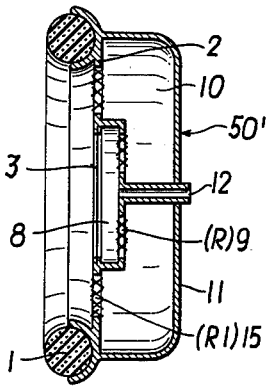
FIGS. 2*a* and 3*a* are views similar to FIG. 1*a* of other embodiments of the invention.
Figure 2B:
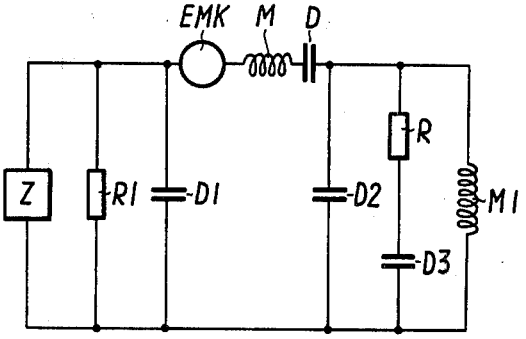
FIGS. 2*b* and 3*b* are views similar to FIG. 1*b*, but referring to the respective showings in FIGS. 2*a* and 3*a;*

A further improvement of the transmission in the earphone of FIG. 1*a* can be achieved in that an acoustic connection 15 is established between the coupling space and cavity 10 which is sealed soundproofly from the outside. This connection is designed as a frictional resistance. In the elementary representation in FIG. 2*a* and the respective equivalent circuit diagram in FIG. 2*b*, this resistance is designated with R1 in an earphone 50'. It is parallel to D1, represented in the equivalent circuit diagram as a capacitor, and regulates the acoustic short circuit from the front side, next to the ear, to the backside of diaphragm 3. In this arrangement, however, there is a drop of the frequency curve below 200 Hz.

The last mentioned irregularities in the frequency course, particularly, the loss below 200 Hz, can be eliminated by the use of passive diaphragms in the connecting path between the coupling space and cavity 10. The elementary representation in FIG. 3*a* of an earphone 50" and the respective equivalent circuit diagram in FIG. 3*b* show this arrangement. A circular opening (for the sake of simplicity), which contains, as shown in both FIGS. 2*a* and 3*a*, an acoustic frictional resistance R1 at 15, is provided in wall 2, which forms both a part of the coupling space and the soundproof cavity 10. In a parallel plane thereto, and at a small distance, a passive diaphragm 14 is arranged, so that an additional small low air chamber is obtained between the frictional resistance 15 (=R1) and the passive diaphragm 14, which has a stiffness D4. In the respective equivalent circuit diagram, it is seen that a damped series-resonant circuit can be obtained with the elements M2, D5 (mass and stiffness of passive diaphragm 14 itself), D4 and R1, which is parallel to the ear impedance Z and represents a shunt for the frequency to which it is tuned. If a frequency rise appears, for example, in the frequency course of the electroacoustic converter, it can be eliminated by corresponding dimensioning of the above-mentioned elements.

In FIG. 4, the sound pressure on the ear with the use of an earphone, according to the invention, is shown as a function of the frequency. The solid line indicates that there is no drop at the lowest, just noticeable frequency of 16 Hz. The progress achieved with the earphone according to the invention is quite considerable, compared to the dotted curve of an earphone of the prior art type. In the conventional earphone, the drop already starts at about 300 Hz, and is about 8 to 10 db per octave. The broken curve represents the rise under 200 Hz achieved with the invention and, hence, a bass boosting frequency required for musical reproductions.

FIGS. 6, 7 and 8 show only schematic cross-sections through practical constructions of the earphones 60, 60' and 60", according to the invention. It should be noted that the earphone according to the invention has two earpieces, as is customary, which are joined with each other over a resilient band. For the sake of simplicity, only one earpiece is shown in a section in FIGS. 6 to 8, as well as in the elementary representations in FIGS. 1 to 3, since the second earpiece is identical with the first one.

In the embodiment shown in FIG. 6, a circum-aural ear cushion 1 is provided, which is secured on the edge of the supporting panel or wall 2. The electroacoustic converter, for example, an electrodynamic system, is arranged in wall 2 and it has a diaphragm 3 with the immersion coil 4 which dips into the air gap of magnet system 6. A perforated protective cover or a rigid grate is arranged in front of diaphragm 3. On the backside of diaphragm 3, a flat air chamber 8 is formed which represents the first acoustically active cavity. Air chamber 8 behind the diaphragm is connected over a frictional resistance 9 with the second larger, acoustically active cavity 10, which is sealed soundproof from the outside. The restoring force of this cavity and of the air enclosed therein, is used to influence the transmission function of the converter, as described above. In wall 2, which defines both cavity 10 and the coupling space, openings connecting both spaces are provided, in which only acoustic frictional resistances 15 are installed in this embodiment. From the flat air chamber 8, behind diaphragm 3, a narrow duct 12, in addition, leads to the outside, which encloses an air mass or plug with a corresponding mass action with regard to diaphragm 3, so that its inherent resonant frequency is reduced. Substantially, only sound waves of the range of the frequencies below 200 Hz issue from opening 13 of duct 12. In addition, only sound waves of this range arrive from the outside in the coupling space.

Instead of one duct 12, several ducts can be provided whose total air mass acts on the diaphragm with the square of the transmission ratio of the diaphragm surface to the sum of the cross-sections of the ducts.

Figure 3A:
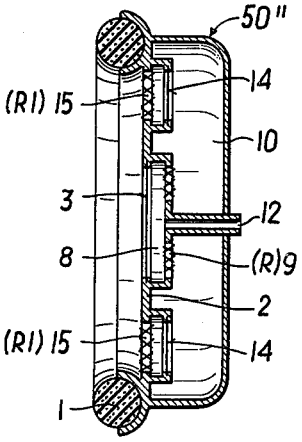
Figure 3B:
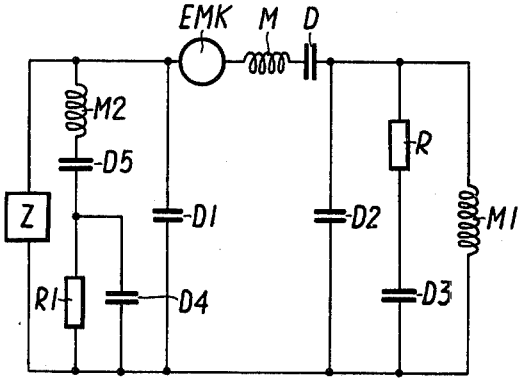

The embodiment shown in FIG. 7 corresponds to the elementary representation in FIG. 3*a*. It differs from the first embodiment in that, in order to improve the linearization of the frequency course in wall 2, the openings over which an acoustic connection is established between the coupling space and the soundproof cavity 10, are provided in passive diaphragm 14, which are damped with acoustic frictional resistances 15. For the mechanical protection of the diaphragms, a metal or plastic grate 16 is provided which almost covers the wall opposite the coupling space completely.

FIG. 8 shows, in a schematic cross-section, one earpiece 60" with a supra-aural ear chusion 17, where the acoustic elements are the same as in the previously described embodiment. In respect to construction, there are slight differences, which are caused by the fact that wall 2 is covered rather extensively by the supra-aural ear cushion and there is no longer room for the openings which connect the coupling space with cavity 10 in the wall panel extending in a plane parallel to the converter diaphragm. The openings are therefore provided in the cylindrical wall portion which is provided for the electroacoustic converter and its mount.

Also different from the above-described embodiments, is the arrangement of duct 12 in the central axis of the converter, while the duct is arranged in the other embodiments eccentrically to the converter axis. The action of duct 12 on the sound pressure curve can be determined by closing opening 13. We then obtain the dotted curve of FIG. 4, as in known earphones. When the opening is exposed, the solid curve or the broken curve for bass boosting is obtained. If an arrangement is now provided which permits by mechanical means, for example, a continuous or gradual adjustment by closing opening 13, the frequency course of the sound pressure on the ear can be varied between the two represented limiting values or be gradually adjusted, if necessary.

If the mechanical arrangement is such that it effects either a reduction of the cross-section of duct 12, or an extension of the latter, the range of the low frequencies can be regulated so that an expansion toward the low frequencies down to 10 Hz and more appears without bass boosting. In the space formed by the ear cushion, a sound-transmitting foam 18 and 18 can be inserted, as indicated respectively in FIGS. 7 and 8, which damps the cavity.

Finally, FIG. 5 shows the insulation values d (in db) of the earphone according to the invention with a circum-aural or supra-aural ear cushion on the basis of the solid curve, while the broken curve shows the insulation values of a conventional earphone, that is, those earphones with a foam-filled ear cushion, but which do not contain the aforestated elements according to the invention. It can be seen that the insulation in the earphone according to the invention is slightly less than in the known earphones, due to the arrangement of duct 12, which leads from flat air chamber 8 behind diaphragm 3 to the outside. The difference, however, is so small that it is meaningless in practice, and is limited to low frequencies, corresponding to the low-pass action of duct 12 in connection with air chamber 8.

The invention is suitable for all types of electroacoustic converters which have a sound-transmitting diaphragm, and thus also suitable for orthodynamic, piezoelectric, electrostatic converters or converters working with an electret. In all of these cases, the invention brings an improved reproduction of the earphone, particularly at frequencies below 200 Hz.

While specific embodiments of the invention have been shown and described in detail to illustrate the application of the principles of the invention, it will be understood that the invention may be embodied otherwise without departing from such principles.

What is claimed is:

1. An earphone construction, comprising a housing having a partition plate with an opening therethrough, an electroacoustic converter having a sound-transmitting diaphragm disposed in the opening with a front side disposed toward a wearer's ear and with an opposite backside, an annular ear cushion secured to the periphery of said partition adapted to engage around the wearer's ear, said ear cushion when engaged with the wearer, forming a coupling space with said diaphragm, a back covering connected to said partition plate and having a portion spaced from said partition plate and defining a sound-proof cavity behind said partition plate, a partial wall spaced from said partition plate on the opposite side thereof from said diaphragm and defining a high restoring force cavity with said partition plate, a duct connected from said high restoring force cavity to the exterior of said housing and partly enclosing an air mass acting as an acoustic mass, and an acoustic frictional resistance defining a communication between said restoring force cavity and said soundproof cavity.

2. An earphone construction, as claimed in claim 1, wherein an additional acoustic frictional resistance is provided in said partition plate between said soundproof cavity and said coupling space on the ear.

3. An earphone construction, as claimed in claim 2, wherein additional acoustic frictional resistance comprises a passive diaphragm provided in said partition between said soundproof cavity and the coupling space on the ear.

4. An earphone construction, as claimed in claim 1, wherein said soundproof cavity is formed by said partition wall, and the exterior wall of said housing comprising said back covering.

5. An earphone construction, as claimed in claim 1, including means associated with said duct for adjusting various frequency courses in the low frequency range.

* * * * *